United States Patent [19]

Brown et al.

[11] 4,110,068

[45] Aug. 29, 1978

[54] HOT ROLLER FUSER HAVING MANUALLY OPERABLE JAM CLEARANCE MECHANISM

[75] Inventors: Leon Calvin Brown; Earl Garland Edwards; Charles Edwin Peterson; Peter George Robinson; Clement Card Wilson, all of Boulder, Colo.

[73] Assignee: International Business Machines Corporation, Armonk, N.Y.

[21] Appl. No.: 771,126

[22] Filed: Feb. 22, 1977

[51] Int. Cl.[2] ..... B65H 29/56

[52] U.S. Cl. ..... 432/60; 271/172; 271/174; 271/195; 271/DIG. 2; 271/DIG. 3; 219/216; 118/60

[58] Field of Search ..... 271/174, 172, 195, DIG. 2, 271/DIG. 3; 432/60, 228; 219/469, 216; 118/60; 355/3 FU

[56] References Cited

U.S. PATENT DOCUMENTS

| | | | |
|---|---|---|---|
| 3,754,819 | 8/1973 | Braun | 432/60 |
| 3,834,861 | 9/1974 | McCarroll | 432/60 |
| 3,926,429 | 12/1975 | Satomi et al. | 271/274 |
| 3,936,045 | 2/1976 | Ariyama | 271/DIG. 2 |
| 3,955,813 | 5/1976 | Edwards | 118/60 |
| 3,973,844 | 8/1976 | McCarroll | 355/3 FU |
| 3,998,584 | 12/1976 | Wada et al. | 432/60 |

*Primary Examiner*—John J. Camby
*Assistant Examiner*—Henry C. Yuen
*Attorney, Agent, or Firm*—Francis A. Sirr

[57] ABSTRACT

An electrophotographic copier having a hot roll fuser assembly. This assembly is slidably supported by a pair of rails. When the fuser assembly is locked into its fusing position, within the copier, it is relatively inaccessible for purposes of inspection, cleaning and/or jam clearance. In its withdrawn, inoperative position, a single manually operable jam clearance handle is operator accessible. Manual actuation of this handle, from a folded to an extended position, is effective to move both a sheet peeler or detach bar, and a sheet transport channel away from the fusing nip. When the handle is moved back to its folded position, the sheet detach bar and transport channel are accurately positioned, and locked in an operative position closely adjacent to the downstream side of the fusing nip, so as to aid in release of the sheet from the fusing nip, and to guide the sheet away from this nip.

14 Claims, 10 Drawing Figures

HOT ROLLER FUSER HAVING MANUALLY OPERABLE JAM CLEARANCE MECHANISM

BACKGROUND AND SUMMARY OF THE INVENTION

While various apparatus for use in fusing toner to a sheet of transport material are known, hot roll fusers are preferred for their electrical efficiency. A problem to be solved, however, is the consistent and reliable release of a sheet from the hot or cold roll as the sheet's leading edge emerges from the fusing nip.

The use of sheet detach means and/or sheet transport channels, downstream of the fusing nip, is known to be desirable in achieving good sheet release. However, these desirable mechanisms increase the complexity of clearing a jam which may occasionally occur in this portion of the copier. To aid in jam clearance the fuser assembly may be mounted on rails, such that it can be withdrawn from the copier to a more accessible position.

The present invention provides a single-handle jam clearance apparatus which is accessible only when the fuser assembly has been withdrawn to its inoperative, jam clearance position. This handle, in one position, locks the aforementioned sheet detach means and sheet transport channel in their operative position, closely adjacent to the output or downstream side of the fusing nip. When the handle is manually moved or unfolded to its jam clearance position, these mechanisms are moved out of the way, thus exposing the fusing nip and the mechanisms for convenient manual jam clearance.

Prior art means are known to facilitate jam clearance in fusers. For example, radiant fusers are known wherein a sheet transport vacuum plenum is pivotally mounted such that the manual release of latches operates to expose the interior of the fuser. In another device, such a fuser is mounted on slides to permit removal, repair or replacement.

In addition, a hot roll fuser is known wherein the fuser assembly is removably supported by upper and lower slides or rails to facilitate movement of the fuser out of the copier.

While jam clearance has been addressed when designing prior art fusers, as above exemplified, prior to the present invention, no means has been provided whereby a simple, single-hand operation of a jam clearance handle either located and locked various sheet handling devices closely adjacent to a hot roll fusing nip, or simultaneously moved all of these devices away from the nip for ease of jam clearance.

The foregoing and other features and advantages of the invention will be apparent from the following more particular description of preferred embodiments of the invention, as illustrated in the accompanying drawing.

INCORPORATION OF RELATED ART BY REFERENCE

Figure 1:
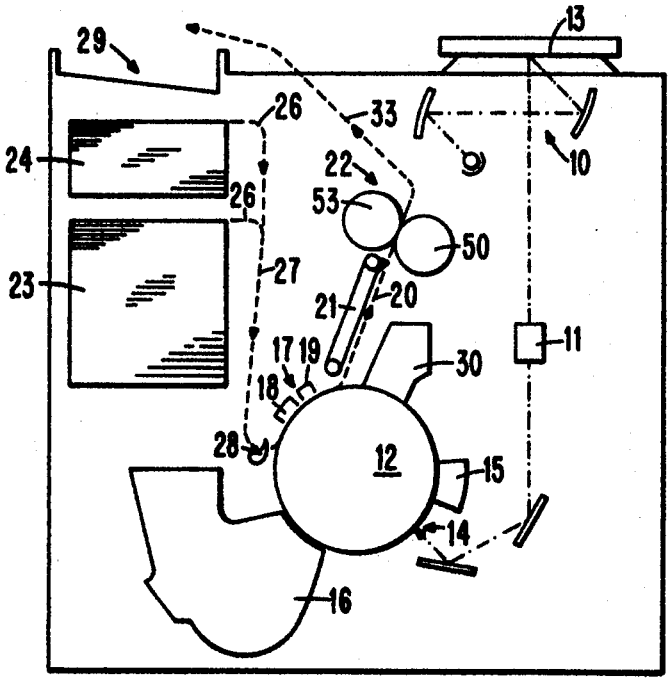
FIG. 1 is a schematic view of an electrophotographic copier embodying the present invention.

The copier schematically depicted in FIG. 1 is the IBM Series III Copier/Duplicator.

The hot roll fuser's sheet peeler or detach bar mentioned herein is more specifically disclosed in U.S. Pat. No. 3,955,813.

DESCRIPTION OF PREFERRED EMBODIMENTS

FIG. 1 is a schematic view of a xerographic copier incorporating the present invention, for example the IBM Series III Copier/Duplicator. In this device a scanning mirror system 10 and a moving lens 11 move in synchronism with the rotation of photoconductor drum 12 to place a latent image of stationary original document 13 onto the drum's surface. As is well known, prior to imaging at 14, the drum is charged by corona 15. After imaging, the drum's latent image is developed by magnetic brush developer 16. Thereafter the drum's toned visible image is transferred to a sheet of copy paper at transfer station 17 by operation of transfer corona 18. Sheet detach means 19 operates to cause the now toned sheet to leave the surface of the drum and to follow sheet movement path 20, adjacent vacuum conveyor 21, on its way to hot roll fuser assembly 22. As the sheet moves through path 20, the sheet's straight leading edge is generally perpendicular to path 20. After fusing, the finished copy sheet follows sheet path 33 and is deposited in output tray 29. After transfer, the drum is cleaned as it passes cleaning station 30.

The apparatus of FIG. 1 includes two copy sheet supply bins 23 and 24. These supply bins include a bidirectionally, vertically movable elevator which supports the stack. While this structure is well known to those of skill in the art, an exemplary structure is described in the IBM TECHNICAL DISCLOSURE BULLETIN of August 1974, at pages 670 and 671. The selected bin is operable to feed the top sheet of the stack to its sheet discharge path 26. This sheet then travels down sheet path 27 to be momentarily stopped at gate 28. An exemplary means of picking the top sheet from the selected bin is described in the IBM TECHNICAL DISCLOSURE BULLETIN of February 1974, at pages 2966 and 2967. Shortly after the leading edge of the drum's toned image arrives at the gate, the gate is opened to allow the sheet to move into transfer station 17 with its leading edge in exact registry with the drum's image leading edge.

Hot roll 50 is heated to an accurately controlled temperature by an internal heater and an associated temperature control system, not shown. The hot roll preferably includes a deformable external surface formed as a thin elastomeric surface. This surface is designed to engage the toned side of the copy sheet, fuse the toner thereon, and readily release the sheet with no adherance of residual toner to the hot roll. Such a hot roll is described, for example, in the IBM TECHNICAL DISCLOSURE BULLETIN of August 1973, at page 896.

As is conventional in hot roll fusers, the sheet's toned side faces the hot roll.

Backup roll 53 is preferably a relatively cool and rigid roll. Rolls 50 and 53 are circular cylinders, such that the fusing nip formed thereby defines a line (of some width due to deformation of hot roll 50) parallel to the axis of rolls 50 and 53.

The fusing nip formed by rolls 50 and 53 may be closed and opened in synchronism with the arrival and departure of the copy sheet's leading and trailing edges, respectively. This synchronism is achieved by a drum position sensing means, not shown, which responds to the position of drum 12 and effects opening and closing of the nip by means of a copier control system, not shown. In the alternative, for a multi-copy run, the fusing nip may continuously remain closed until the trailing end of the last sheet has passed therethrough.

Sheet supply bins 23 and 24 are constructed and arranged to adjustably hold cut sheets or transfer material of different sizes, for example letter and legal size paper. Sheets therein are oriented such that their narrow dimension is in the direction of paper feed 27. In addition, the sheets in each bin are stacked such that their rearmost narrow edge (which is parallel to the direction of paper feed 27) lies in a common vertical plane. Thus, if bin 24 contains legal size paper, its front narrow edge overlaps the front narrow edge of letter size paper in bin 23 by some three inches. As a sheet travels down sheet path 27 its long leading edge is presented to transfer station 17 such that this edge is substantially parallel to the axis of photoconductor drum 12.

Figure 2:
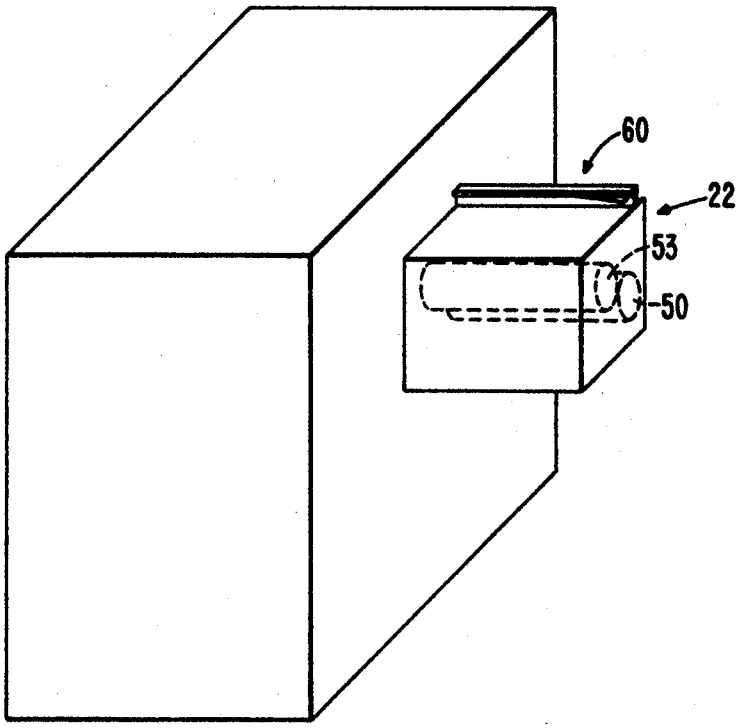
FIG. 2 is a simplified perspective view of the copier of FIG. 1, showing its hot roll fuser assembly in its extended, inoperative or non-fusing position.

FIG. 2 shows fuser assembly 22 in its extended or pulled-out position. Assembly 22 is pulled out of the front of the copier. Other copier means are not shown in FIG. 2 for purposes of simplicity. FIG. 2 shows the non-operating position of the fuser assembly. This position is adapted to facilitate inspection, cleaning, repair and/or sheet jam clearance. The fuser assembly is slidably supported by a pair of rail assemblies, one of which is shown at 60. Each rail assembly includes a plurality of stationary internal rollers, not shown, over which a rail slidably moves. These rails support the fuser assembly, and move therewith.

Figure 3:
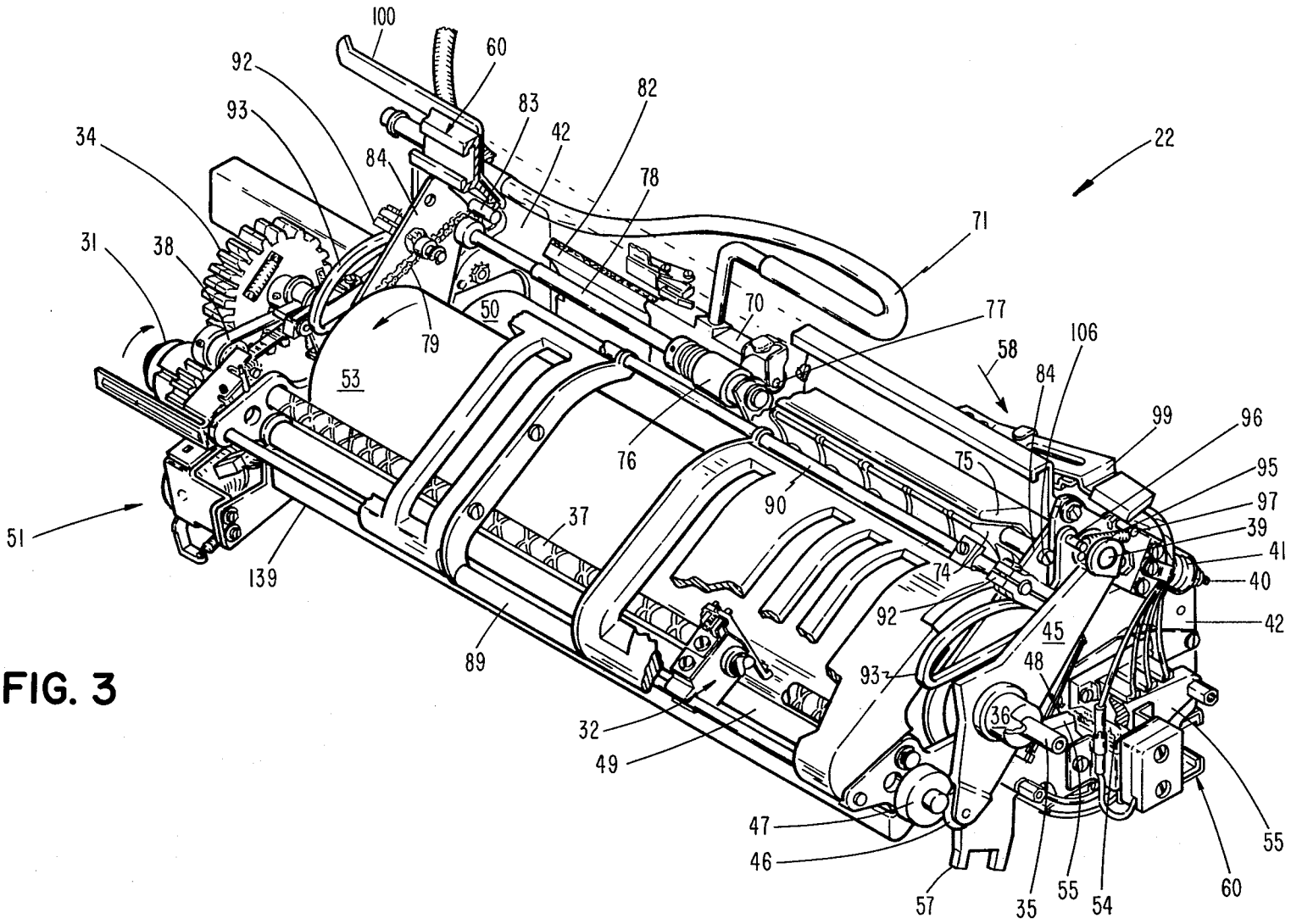
FIG. 3 is a detailed perspective view of the hot roll fuser assembly per se, as it would appear in the extended position of FIG. 2.

Referring now to FIG. 3, reference numeral 31 identifies a drive coupling which is adapted to axially slide and mate with a fixed-position coupling (not shown) within the copier. Coupling 31 rotates clockwise, as shown by the associated arrows, so long as the copier's main drive motor (not shown) is rotating. The means for applying motive power to coupling 31 may be as described in the IBM TECHNICAL DISCLOSURE BULLETIN of October 1976, at pages 1597 and 1598.

Coupling 31 meshes with anti-backlash gear 34, this gear being fixed to shaft 35 which supports backup roll 53, thus causing roll 53 to rotate counterclockwise, as shown by the associated arrow. The extended end of shaft 35 includes a coupling 36 adapted to receive a hand crank (not shown).

Reference numeral 32 identifies a scraper-type cleaning mechanism for backup roll 53. This mechanism travels back and forth down the axial length of the backup roll, moving along leadscrew 37. This leadscrew is driven by drive belt 38 which is in turn driven by a gear (not shown) which is secured to shaft 35.

The details of construction of cleaning mechanism 32 may be as described in the IBM TECHNICAL DISCLOSURE BULLETIN of July 1975, at page 326. The debris removed from the backup roll falls into a channel-like holder 139, for later removal during periodic copier maintenance.

The backup roll's rotational axis, as defined by shaft 35, is movable in a short arc about a pivot axis defined by two spring-loaded points 39, one such point 39 at each end of the fuser assembly. Each of these points 39 is supported by a bolt 40 which is encircled by a compression spring 41. One end of this compression spring rests against a fixed-position fuser frame member 42 (one member 42 resides at each end of the fuser assembly), while the opposite end of this compression spring rests against a washer 43 which is adjustably positioned along bolt 40 by virtue of nut 44.

An exemplary means of so mounting backup roll 53 is shown in the IBM TECHNICAL DISCLOSURE BULLETIN of May 1973, at page 3644.

Shaft 35 is bearing-supported at its opposite ends by two backup roll actuating arms 45. Each of these arms carries a cam following roller 46 at its lower end. This roller is force-biased against a cam 47 whose rotation effects closing of the fusing nip by virtue of axis movement of the backup roll, as will be described. The force-biasing of each of the arms 45 is achieved by leaf springs 48 which exert a force between arms 45 and frame member 42.

The two cams 47 (at each end of the fuser assembly) are fixed to opposite ends of shaft 49 so as to rotate therewith. Shaft 49 is selectively coupled to coupling 31 by way of a solenoid-controlled, partial revolution, or one-half revolution clutch generally indicated at 51, FIG. 3. So long as this solenoid is deenergized, shaft 49 does not rotate. Thus, cam 47 and roller 46 remain in the positions shown in FIG. 6, i.e. the fusing nip open position. When this solenoid is energized, a clutch sleeve is released for rotation, and rotational power is applied to shaft 49, from coupling 31, causing the shaft and its cam 47 to rotate clockwise for approximately one-half a revolution, until cam 47 and roller 46 assume the FIG. 5 position. At this point, solenoid energization causes the above-mentioned clutch sleeve to again be held against rotation. As a result, the clutch releases and shaft 49 is uncoupled from coupling 31.

Figure 5:
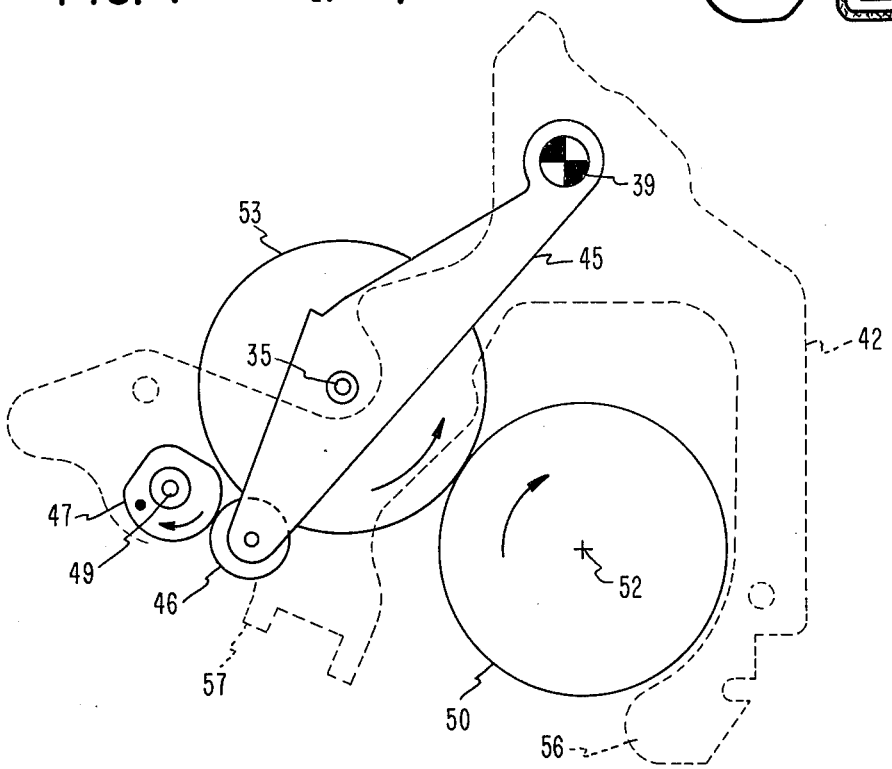
FIG. 5 is a simplified view similar to FIG. 4, showing the fusing nip in its closed position.

The fusing nip between hot roll 50 and backup roll 53 has now been closed by counterclockwise rotations of arms 45 (one at each end of the fuser assembly) about pivot points 39, see FIG. 5.

Figure 6:
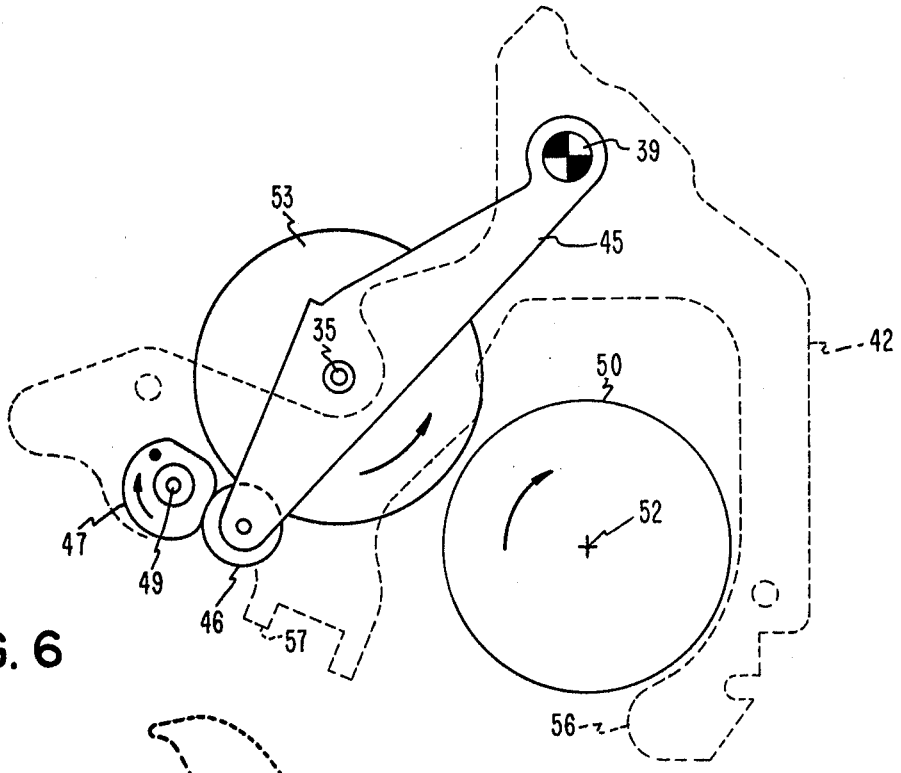
FIG. 6 is a view similar to FIG. 5, but showing the fusing nip in its open position.

Subsequently, when it is desired to open the fusing nip, solenoid deenergization again releases the above-mentioned clutch sleeve, allowing it and shaft 49 to rotate clockwise for one-half revolution, such that FIG. 6's nip open condition is reestablished. In this position, the deengaged solenoid again holds the clutch sleeve against further rotation, thus uncoupling shaft 49 from coupling 31.

Figure 4:
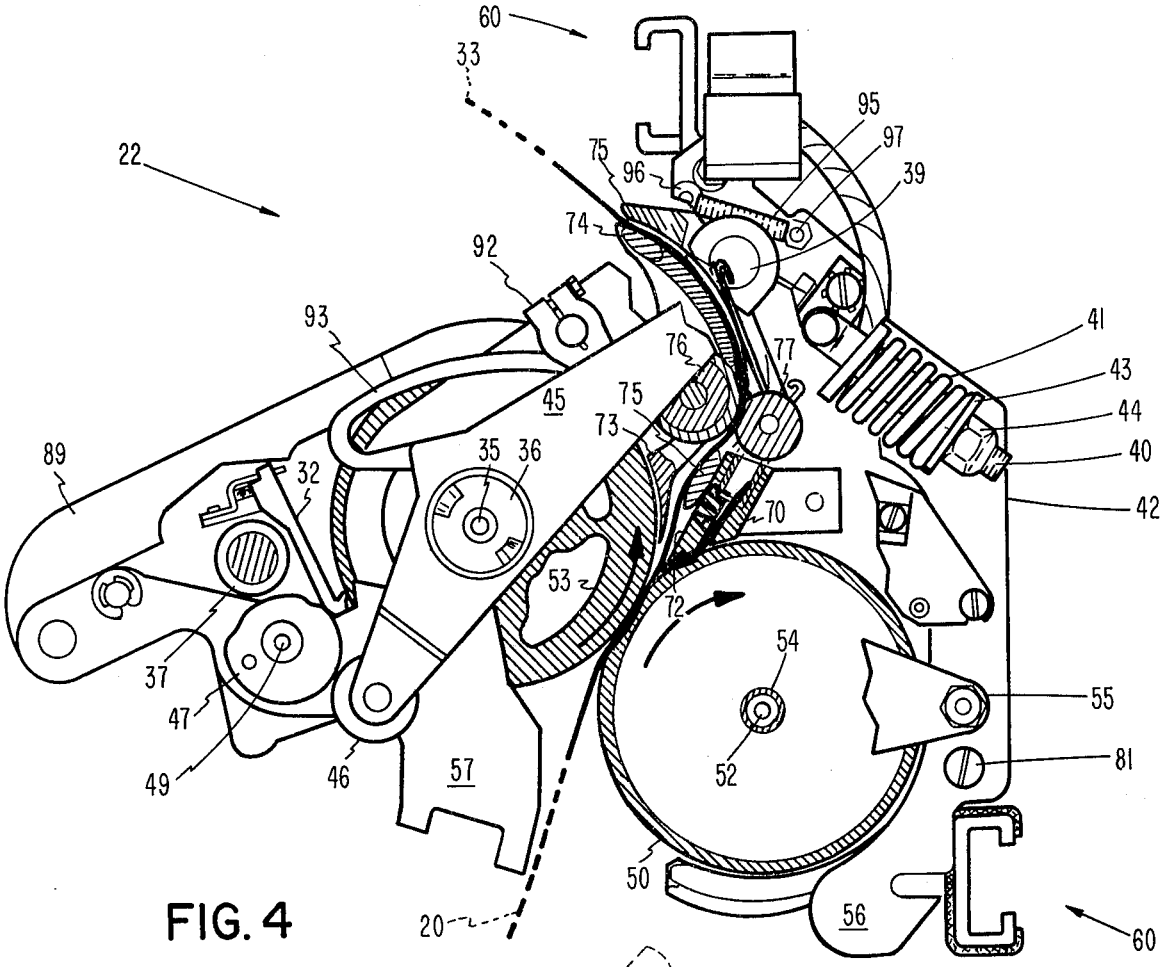
FIG. 4 is a section-like view of the hot roll fuser assembly of FIG. 3.

Hot roll 50 rotates about a fixed position axis 52. This axis is coincident with an elongated heating lamp 54 (FIGS. 3 and 4). Roll 50 is bearing supported at its opposite ends by way of two plates 55 which are secured to the portions 56 and 57 of each of the two frame members 42. Roll 50 is driven through engagement with backup roll 53, and thus it does not rotate when the fusing nip is open, as it is in FIG. 6.

Preferably, backup roll 53 is rigid, whereas hot roll 50 is deformable under the nip closing pressure which operates to force the backup roll into the resilient surface of the hot roll. U.S. Pat. No. 3,848,305 describes such a hot roll, this roll being constructed and arranged such that dry release of the sheet being fused is achieved.

With reference to FIG. 4, when the leading edge of a sheet being fused emerges from the closed fusing nip formed by rollers 50 and 53, this leading edge is aided in the release of its toned side from roll 50 by way of a sheet peeler or detach bar 70. This bar is described in detail in aforementioned U.S. Pat. No. 3,955,813, and includes pressurized air flow supplied thereto by a flexible hose 71 (FIG. 3). Bar 70 extends the axial length of the fusing nip and penetrates the wedge-shaped space between rolls 50 and 53 so as to achieve leading edge sheet release closely adjacent the downstream side of the fusing nip.

Bar 70 also includes a planar-like surface 72 (FIG. 4) which cooperates with the emerging sheet to form one wall of a first sheet transport channel. The opposite wall of this channel is formed by an elongated member 73 which also penetrates the wedge-shaped space between rolls 50 and 53 so as to be positioned closely adjacent the downstream side of the fusing nip. Member 73 is an integral extension of a sheet transport guide 74, also seen in FIG. 3. Surface 72 cooperates with spaced sheet transport guide member 73 to form a sheet transport assembly upstream of that provided by 74 and 75.

The assembly 74, 75 includes a sheet drive means in the form of a driven roller 76 and an idler roller 77. As seen in FIG. 3, driven roller 76 is supported by shaft 78. This shaft is driven by chain 79, the chain in turn being driven by a gear (not shown) which is attached to rotate with the backup roll's shaft 35.

The present invention provides a unique means of supporting and locking members 70, 73–74, 75, 76 and 77 in a first operative position closely adjacent to the downstream side of the fusing nip, as seen in FIG. 4, or moving these members to a second inoperative position away from the fusing nip to facilitate inspection, cleaning and/or sheet jam clearance.

More specifically, and with reference particularly to FIGS. 7–10, opposite ends of detach bar 70 are attached to two pivoted plates 80. Each of the plates 80 is pivotally secured to its frame member 42 by way of pivot 81 (also seen in FIG. 4). Pivot 81 also provides pivoted support for a heat shield 82 (FIGS. 3 and 9) which partially surrounds hot roll 50.

In the operative position of plates 80, detach bar 70 is accurately positioned closely adjacent to the surface of hot roll 50 by virtue of engagement with stop pin 83 carried by each of the frame members 42. One of these pins is also shown in FIG. 3.

Sheet guide members 73–74 and 75, and drive roller 76 and idler roller 77 which are integral therewith, respectively, are supported by having their opposite ends attached to two pivoting plates 84. These two plates are also seen in FIG. 3. Each of these plates pivots about a large circular disk 85 (FIGS. 9 and 10) which encircles the backup roll's shaft 35, and is fixed to its frame member 42 by way of bolts, not shown. Each plate 84 has a large mating opening 86 which receives the outer diameter of disk 85 to pivotally support plate 84 on its frame member 42. Each plate 84 also includes a locking tab 87 which is adapted to engage a locking pin 88 carried by its mating plate 80.

Figure 7:
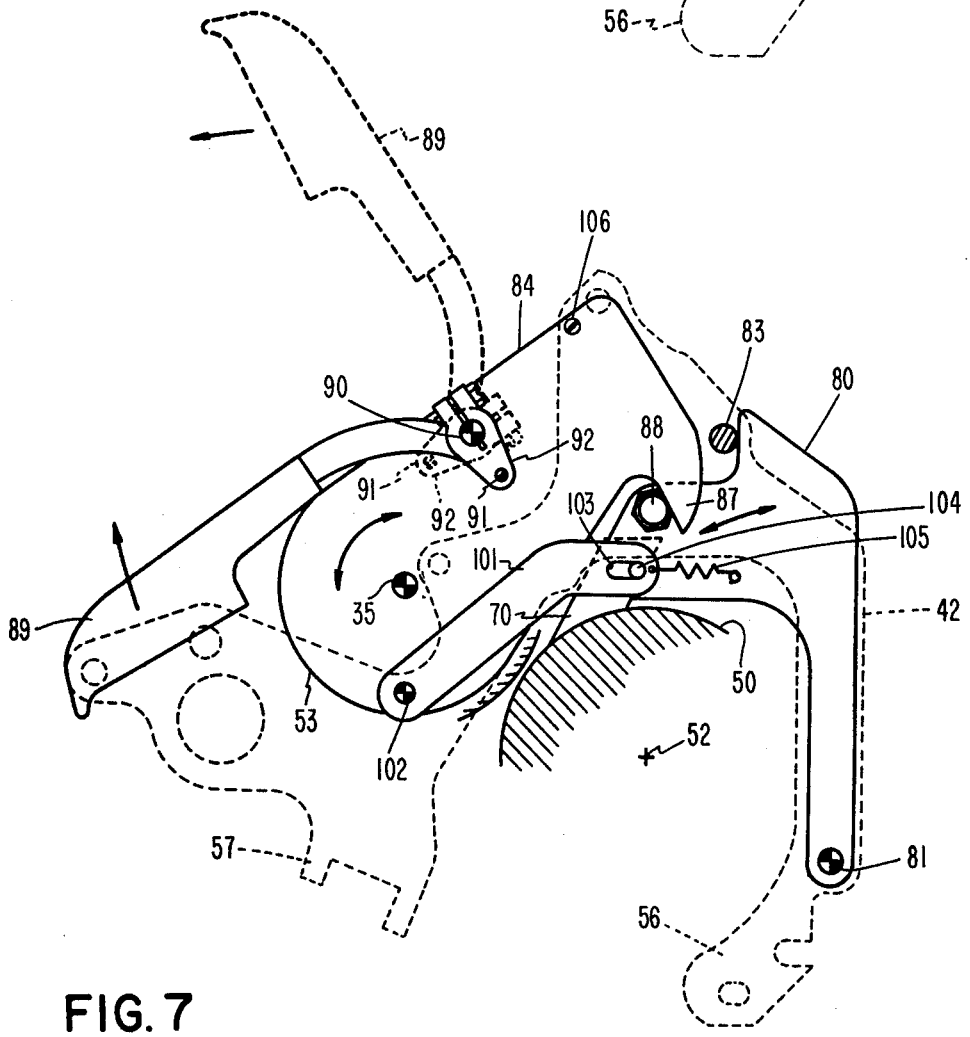
FIGS. 7, 8 and 9 show the fusing nip open, and the manually operable jam clearance handle in a number of its positions between the folded and extended positions, whereby the fuser's sheet peeler bar and transport channel are movably positioned.

A manually operable sheet jam clearance handle 89 (also shown in FIGS. 3 and 4) is secured to a shaft 90 such that unfolding of the handle from its solid line position in FIG. 7 to its dotted line position causes shaft 90 to rotate clockwise. Opposite ends of shaft 90 are pivotally mounted in plates 84.

Each end of shaft 90 includes a detent locking pin or roller 91 held by a link 92 secured to shaft 90. The two links 92 are also shown in FIG. 3, and one of them is shown in FIG. 4.

Two internal cam members 93 (FIGS. 3, 4, 8, 9 and 10) are located one at each end of the fuser assembly. Each such cam member is pivotally secured to its frame member 42 by way of pivot 94, and is biased for clockwise rotation about its pivot by a tension spring 95. One end of spring 95 is secured to its cam member 93 at pin 96, whereas the other end of the spring is secured to its frame member 42 at pin 97, also see FIG. 3.

When handle 89 is in its folded, solid line position of FIG. 7, i.e. the operative position of FIG. 4, locking pin 91 rotates in a counterclockwise direction, up into the locking detent portion 98 on the internal cam surface. As a result, handle 89 is releasably detent-locked in this position, as spring 95 is tensioned.

At least one of the plates 84 pivotally carries a drive link 101, by way of pivot 102. The other end of link 101 includes an elongated slot 103 which receives a pin 104 secured to its mating plate 42. A tension spring 105 extends between this end of link 101 and plate 42.

The operative position of plate member 84, and thus sheet transport members 73–74, 75, as well as drive roller 76 and idler roller 77, is established by a pin 106, as this pin cooperates with the frame members 42. As seen in FIG. 3, pin 106 may be the head extension of a bolt which fastens the opposite end's sheet transport member 73–74 to plate members 84.

When it is desired to move detach bar 70 and the sheet guide means including members 73–74, 75 away from the fusing nip, fusing assembly is first withdrawn to its FIG. 2 position. A release latch 99 (FIG. 3), and an out-stop catch 100 facilitate this operation, latch 99 releasing the fusing assembly for sliding outward movement, and catch 100 preventing complete removal of the assembly. Handle 89 is now accessible for single-hand operation.

Figure 8:
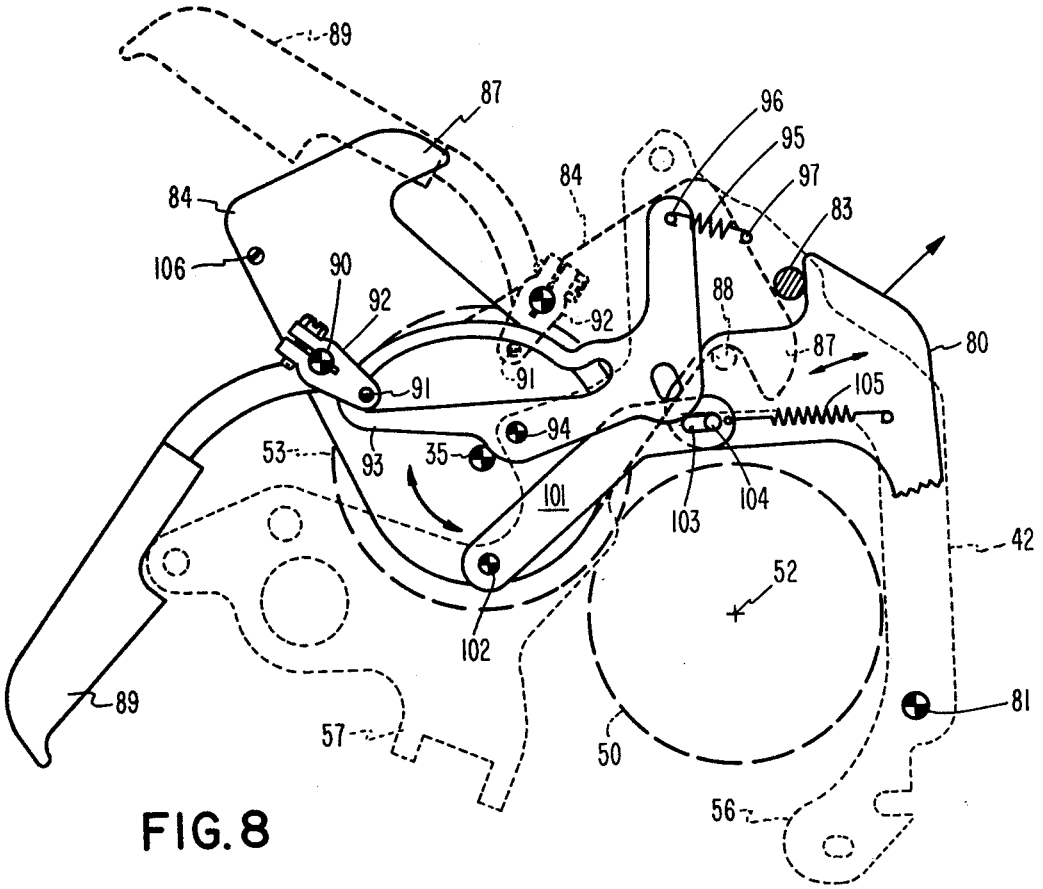
Figure 9:
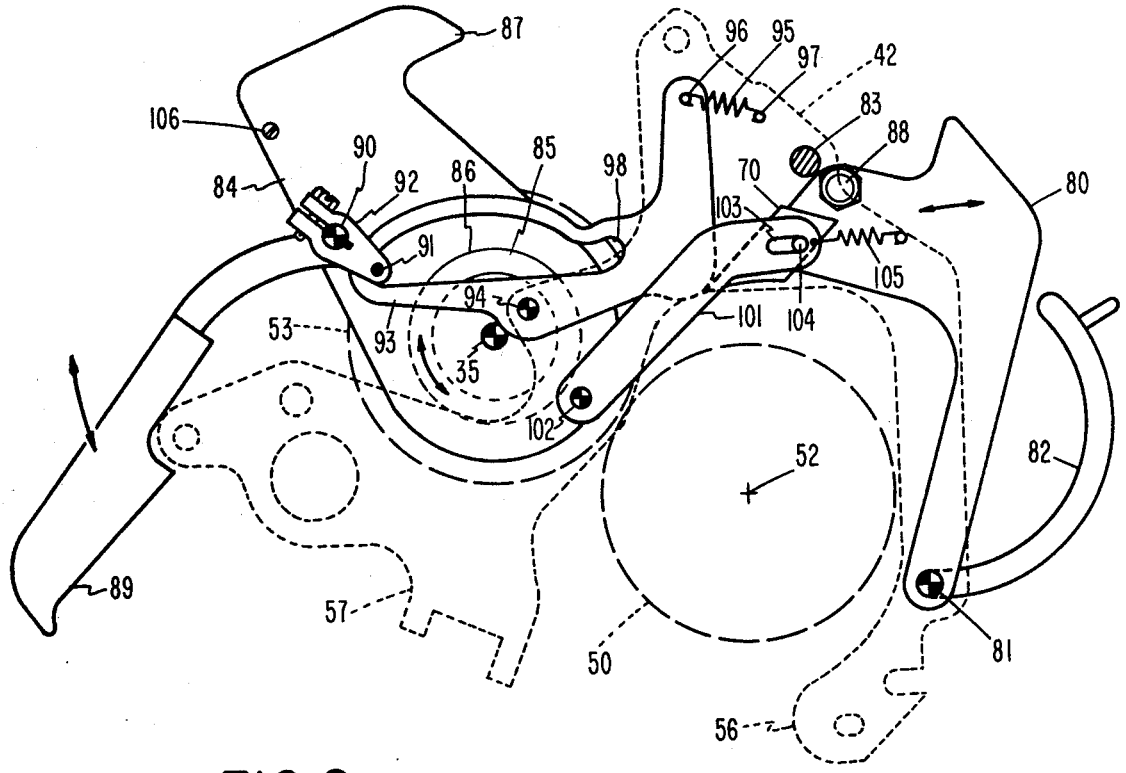
Figure 10:
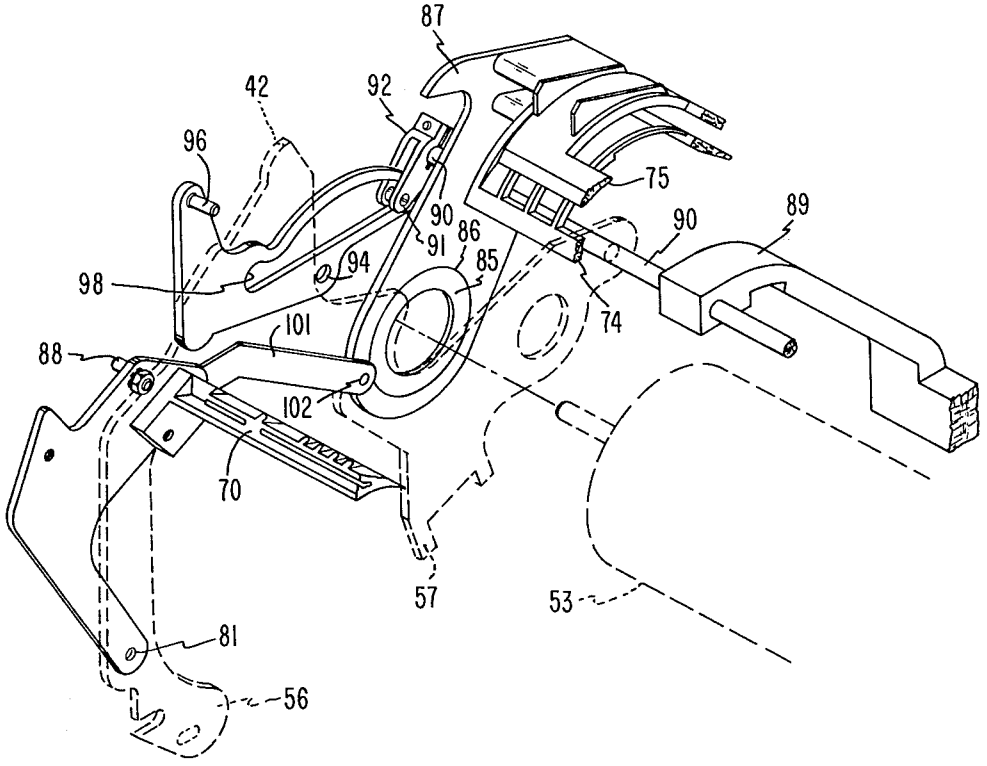
FIG. 10 is a perspective view of the apparatus of FIGS. 7–9, as seen from the opposite side thereof, when viewing the apparatus from the direction generally identified by arrow 58 of FIG. 3.

With reference to FIG. 7, handle 89 is now manually rotated clockwise about its pivot 90, to the dotted line position. In this position locking pin 91 has been released from locking detent 98. This is the dotted line position of 91 relative to cam member 93, as seen in FIG. 8.

With reference to that Figure, handle 89 is now pulled to the left and down, to the solid-line position shown therein. This movement causes plates 84 to rotate counterclockwise, from their operative dotted-line position to their inoperative solid-line position. By so doing, the position of the sheet guide means 73–74 and 75 is moved out of the fusing nip to a stable elevated position.

During this movement of handle 89, the counterclockwise pivoting of plate 84 operates through drive link 101 to cause its associated plate 80 to rotate clockwise about its pivot 81. If only one drive link 101 is provided, at one end only of the fuser assembly, then detach bar 70 transmits a similar rotational force to the plate 80 at the other end of the fuser assembly. In any event, this movement of plates 80, to the solid-line position of FIG. 9, operates to elevate detach bar 70 away from the fusing nip to a stable inoperative position.

The fusing nip is now accessible for sheet jam clearance, for example. To restore the members 73–74, 75 and 70 to their operative positions, the handle movement is reversed. In this operative position these members are accurately positioned and locked.

While the invention has been particularly shown and described with reference to preferred embodiments thereof, it will be understood by those skilled in the art that various changes in form and details may be made therein without departing from the spirit and scope of the invention.

What is claimed is:

1. In an electrophotographic device wherein toner carried by a sheet of transfer material is fused to said sheet by the fusing nip of a hot roll fuser assembly, the improvement comprising:

sheet guide means movably supported on said fuser assembly and positioned upstream of said fusing nip, said sheet guide means being operative in a first position to receive and guide a sheet away from said fusing nip as the sheet's leading edge emerges therefrom;

manually operable means supported on said fuser assembly, said manually operable means having a first and a second position, and being connected to move said sheet guide means to a second position away from said fusing nip upon operation of said manually operable means to its second position, to thereby allow access to said fusing nip for purpose of sheet jam clearance and the like; and locking means controlled by said manually operable means when in its first position to lock said sheet guide means in its first position.

2. The device defined in claim 1, including sheet detach means movably supported on said fuser assembly and positioned upstream of said fusing nip, said sheet detach means being operable in a first position to aid in the release of the sheet's leading edge as it emerges from said fusing nip; and coupling means connecting said sheet detach means and said manually operable means whereby said manually operable means when in its second position is additionally arranged to move said sheet detach means to a second position away from said fusing nip, as said sheet guide means is moved to its second position.

3. The device defined in claim 2, including sheet drive means supported by said sheet guide means adjacent said fusing nip when said sheet guide means is in its first position.

4. The device defined in claim 3 wherein said sheet detach means includes means to guide the sheet's released leading edge sheet into said sheet drive means.

5. The device defined in claim 4 wherein the first position of said sheet detach means and said sheet guide means results in said means being positioned immediately upstream of the fusing nip.

6. The device defined in claim 5 wherein said manually operable means includes a handle having a first folded and a second extended position corresponding respectively to the first and second positions of said sheet guide means and said sheet detach means, and releasable detent means operable to lock said handle in said folded position.

7. A hot roll fusing assembly, comprising:

a fixed axis hot roll;

a movable axis cold roll;

means operable to move said cold roll into engagement with said hot roll to form a fusing nip;

a sheet detach bar extending along said fusing nip, on the downstream side thereof, and cooperating with said fusing nip to aid in the release of the leading edge of a sheet of transfer material;

said sheet detach bar including a first guide surface to guide the sheet's leading edge as it leaves said fusing nip;

a sheet transport assembly extending along said fusing nip, on the downstream side thereof;

said transport assembly including an extending second guide surface cooperating with said first guide surface to form a first channel through which the sheet's leading edge is guided as it leaves said fusing nip;

said transport assembly including sheet drive means and a second sheet guide channel downstream of said first channel; and operable handle means with said sheet detach bar and said transport assembly and operable to simultaneously move the same to an inoperative position clear of said fusing nip, to facilitate jam clearance.

8. The fusing assembly defined in claim 7, including support means operable to facilitate movement of said fusing assembly from a fusing position to a jam clearing position, said manually operable means being accessible only in said jam clearing position.

9. The fusing assembly defined in claim 8 wherein said sheet detach bar cooperates with said hot roll to aid in the release of the toned side of the sheet therefrom, and wherein both said sheet detach bar and said sheet transport assembly extend substantially the full length of said fusing nip.

10. The fusing assembly defined in claim 9 wherein said manually operable means comprises a manually operable handle having a folded and an extended position, said extended position corresponding to the inoperative position of said sheet detach bar and said transport assembly, and releasable detent lock means operable to lock said handle in its folded position.

11. The fusing assembly defined in claim 10 wherein said sheet detach bar and said sheet transport assembly are positioned closely adjacent said fusing nip, and in the wedge-shaped space formed by said hot and cold roll, when said handle is in its folded position.

12. A hot roll fuser assembly, comprising:

a hot roll and a backup roll cooperating to form an elongated fusing nip, a pair of fuser assembly frame members rotationally supporting the opposite ends of said hot roll and backup roll, an elongated sheet detach bar and an elongated sheet transport assembly mounted closely adjacent the output side of the fusing nip, and operable to cooperate with the leading edge of a sheet as it exits the fusing nip, a first set of pivoting plate members pivotally secured one to each of said frame members, means mounting opposite ends of said sheet detach bar to said first set of plate members, first stop means operable between said first set of plate members and said frame members, and operable to establish an operative position for said sheet detach bar closely adjacent the output side of said fusing nip, a second set of pivoting plate members pivotally secured one to each of said frame members, means mounting opposite ends of said sheet transport assembly to said second set of plate members, second stop means operable between said second set of plate members and said frame members, and operable to establish an operative position for said sheet transport assembly closely adjacent the output side of said fusing nip, an elongated manually operable handle having its opposite ends connected to one of said first or second set of plate members, said handle having a first position whereat said one set of plate members positions its associated sheet detach bar or sheet transport assembly in said operative position, and a second position whereat said one set of plate members and its associated sheet detach bar or sheet transport assembly are moved away from said operative position to thereby expose said fusing nip, and drive link means connecting said one set of plate members to the other set of plate members such that movement of said handle to said second position also effects most of said other set of plate members so as to move its associated sheet detach bar or sheet transport assembly away from said operative position to thereby expose said fusing nip.

13. The hot roll fuser assembly defined by claim 12 including releasable loading means operable between said first and second sets of plate members when they position said sheet detach bar and said sheet transport assembly in said operative positions.

14. The hot roll fuser assembly defined by claim 13 including second releasable locking means to lock said handle in said first position.

* * * * *